US006461256B1

(12) United States Patent
Popeck

(10) Patent No.: US 6,461,256 B1
(45) Date of Patent: Oct. 8, 2002

(54) BASKETBALL SHOOTING TRAINING DEVICE AND METHOD FOR APPLYING THE SAME

(76) Inventor: Raymond J. Popeck, 340 Woodside Dr., Washington, PA (US) 15301

( * ) Notice: Subject to any disclaimer, the term of this patent is extended or adjusted under 35 U.S.C. 154(b) by 0 days.

(21) Appl. No.: 09/897,662

(22) Filed: Jul. 2, 2001

(51) Int. Cl.[7] ..... A63B 69/00
(52) U.S. Cl. ..... 473/450; 482/124
(58) Field of Search ..... 473/450, 446, 473/442, 447; 602/17, 18, 19; 482/124

(56) References Cited

U.S. PATENT DOCUMENTS

| | | | | | |
|---|---|---|---|---|---|
| 443,764 | A | * | 12/1890 | Hillard | 602/19 |
| 1,618,273 | A | * | 2/1927 | Davidson | 482/124 |
| 3,620,211 | A | * | 11/1971 | Goodell | 602/6 |
| 3,820,783 | A | | 6/1974 | Caveness | |
| D265,493 | S | | 7/1982 | Kringlie | |
| 4,383,685 | A | | 5/1983 | Bishop | |
| 4,579,341 | A | | 4/1986 | Furr | |
| 4,919,425 | A | | 4/1990 | Wolf | |
| 5,135,217 | A | | 8/1992 | Swain | |
| 5,271,617 | A | | 12/1993 | Gilford | |
| D351,438 | S | | 10/1994 | Weaver | |
| 5,372,565 | A | * | 12/1994 | Burdenko | 482/124 |
| 5,582,402 | A | | 12/1996 | Gilford | |
| 5,816,952 | A | | 10/1998 | Blevins | |

* cited by examiner

*Primary Examiner*—Paul T. Sewell
*Assistant Examiner*—M. Chambers
(74) *Attorney, Agent, or Firm*—John Gugliotta; P. Jeff Martin

(57) ABSTRACT

A basketball shooting training device is provided for training a player to use the proper upper torso alignment and relative leg position when shooting a basketball by maintaining the shooter's back and head, from buttocks to the top of the head in vertical alignment, at a 90° angle with respect to the floor. Also, the invention forces the use of the legs in the set shot for developing novice players' skills. The support rod removably attaches around the forehead via an elastic, adjustable forehead strap attached to an upper end of the rod. The rod continues down the neck and spine, and concludes at the buttocks region. A feet immobilizing apparatus is attached at a lower end of the support rod so as to maintain a player's feet in proper position during consecutive basketball shots.

18 Claims, 6 Drawing Sheets

BASKETBALL SHOOTING TRAINING DEVICE AND METHOD FOR APPLYING THE SAME

RELATED APPLICATIONS

The present invention was first described in Disclosure Document No. 479,756 filed on Sep. 14, 2000. There are no previously filed, nor currently any co-pending applications, anywhere in the world.

BACKGROUND OF THE INVENTION

1. Field of the Invention

The present invention relates generally to a sports training device and, more particularly, to a basketball shooting or golf, baseball, or hockey swing training device and method for applying the same.

2. Description of the Related Art

A major mistake made by many novice basketball players is that they begin shooting using improper vertical alignment of their torso. The early inclination to lean forward or backward makes it very difficult if not impossible to coordinate proper shooting alignment over a continual and habitual basis. Keeping the elbow and the shooting forearm straight along with proper ball revolution are important factors; however, maintaining proper vertical alignment of one's torso is equally important for developing a proper basketball shot. When a player leans beyond the proper vertical alignment, either forward or backward, such action interferes with the proper shooting distance between the player and the basket, thus the player has a tough battle developing a sense of proper shooting distance over a continual basis which accounts for shooting inaccuracies. Further, younger players learning to use a "set shot" need to develop the proper use of the legs during such a shot. Applying the aforementioned factors simultaneously allows a player to develop a basketball shot with desirable accurate trajectory and will thus increase shooting percentages. And, the vertical alignment achieved, in conjunction with the immobilization of the head and proper feet positioning, forces a shooter to maintain proper balance to draw shot strength from movement of the legs.

Accordingly, there is a need for a means by which a basketball player can maintain proper vertical alignment, proper feet position, and proper balance when shooting a basketball so as to increase shooting percentages.

A search of the prior art did not disclose any patents that read directly on the claims of the instant invention; however, the following references were considered related.

U.S. Pat. No. D 351,438 issued in the name of Weaver is an ornamental design of a device that attaches around the waist and arm.

U.S. Pat. No. D 265,493 issued in the name of Kringlie is an ornamental design showing a body harness and a hoop through which a ball is shot.

U.S. Pat. No. 5,816,952 issued in the name of Blevins is a shooting apparatus for the arm, line of sight, wrist and hoop to shoot through.

U.S. Pat. No. 5,582,402 issued in the name of Gilford is a device to teach ball rotation that attaches to the arm and the hand.

U.S. Pat. No. 5,271,617 issued in the name of Gilford is an aid to strengthen the shooting muscles in the forearm, wrist, hand and fingers.

U.S. Pat. No. 5,135,217 issued in the name of Swain is a brace to achieve the proper "cocked" position of a hand and wrist for shooting.

U.S. Pat. No. 4,919,425 issued in the name of Wolf is a strap for the non-shooting guide hand to eliminate undue influence by that hand.

U.S. Pat. No. 4,579,341 issued in the name of Furr is a body harness with shooting arm guide to train the upper torso and shooting arm to achieve an optimum position.

U.S. Pat. No. 4,383,685 issued in the name of Bishop is a vest with rotating device for the shooting arm to maintain position through the shot and follow through.

U.S. Pat. No. 3,820,783 issued in the name of Caveness is an adaptable belt supported bracket to place the shooting arm at the proper height when shooting a basketball.

Consequently, a need has been felt for providing a device which allows a basketball player to maintain proper vertical alignment, proper feet position, and proper balance when shooting a basketball in a manner which is quick, easy and efficient.

SUMMARY OF THE INVENTION

Therefore, it is an object of the present invention to train a player to use the proper upper torso alignment and leg strength when shooting a basketball or swinging a club, bat, or stick.

It is another object of the present invention to provide a lightweight device which has a length which extends down a neck and spine, and concludes below the buttocks region of a user.

It is another object of the present invention to provide a device which attaches to the user's waist via an elastic strap.

It is another object of the present invention to provide a device which attaches to the user's upper thigh and lower waist via an elastic strap to be used in conjunction with an attached alignment rod to prevent a forward and backward bending motion of the back.

It is another object of the present invention to provide a circular, adjustable feet restraining device removably securable around one's ankles so as to refrain a player from sliding one foot too far forward in front of another, or too far backward from the other while shooting.

It is another object of the present invention to provide a circular, adjustable feet restraining device to properly accommodate the user's height and feet position.

It is another object of the present invention to provide a means to refrain a player from sliding one foot too far forward in front of another, or too far backward from the other while shooting.

It is another object of the present invention to provide an adjustable loop and ankle loops which slide on user's ankles for signaling the user when bending excessively forward or backward which thus alerts user to correct his torso alignment.

It is another object of the present invention to alert a user when leaning beyond the proper vertical alignment.

It is another object of the present invention to provide a device which cushions and supports the neck against an alignment rod to insure an immovable head position.

It is another object of the present invention to provide a device which is removably secured to the user's head via an attached, elastic forehead strap.

It is another object of the present invention to provide an adjustable, elastic forehead strap which accommodates all head sizes.

It is another object of the present invention to provide a device which is removably secured to the user's waist via an attached, elastic waist strap.

It is another object of the present invention to provide an adjustable, elastic waist strap which accommodates most waist sizes.

It is another object of the present invention to provide an adjustable alignment rod to fit users of different heights.

It is another object of the present invention to accommodate both right-handed players and left-handed players.

It is another object of the present invention to provide a safe device.

It is still another object of the present invention to provide a lightweight device which is easily transportable.

It is yet another object of the present invention to provide a device which, by pressure application and adjustment, will cause a player to keep himself facing square to an addressed object.

Briefly described according to one embodiment of the present invention, a basketball shooting training device is provided for training a player to use the proper upper torso alignment and relative feet and leg position when shooting a basketball. The present invention maintains the shooter's back and head, from buttocks to the top of the head in vertical alignment, at a 90° angle with respect to the floor. The invention is a rod that removably attaches around the forehead via an elastic, adjustable forehead strap which is attached to an upper end of the rod. The rod continues down the neck and spine, and concludes below the buttocks region. An adjustable, elastic waist strap is attached to a lower end of the rod and encircles the user's waist, while the bottom of the rod extends below the user's buttocks. The lower end of the rod is attached to the user's lower waist and upper thigh by an elastic strap.

The use of the present invention allows a basketball player to maintain proper vertical alignment, feet position, and balance when shooting a basketball in a manner which is quick, easy and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Figure 1:
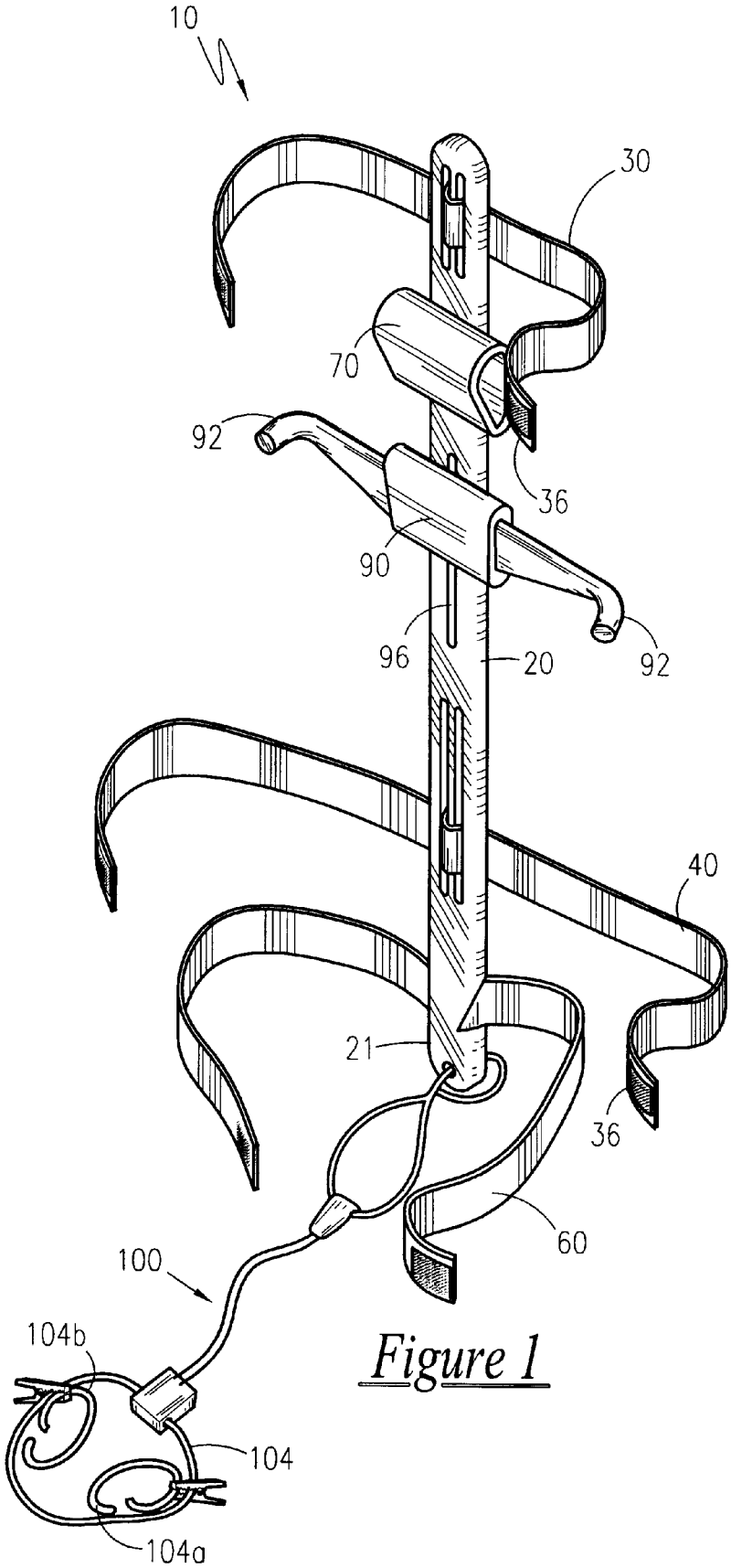
FIG. 1 is a perspective view of a basketball shooting training device according to the preferred embodiment of the present invention.

1. Detailed Description of the Figures Referring now to FIGS. 1–11*c*, a basketball shooting training device 10 is shown, according to the present invention, comprised of an alignment rod 20, an elastic forehead strap 30, and an elastic waist strap 40 for training a user to employ the proper upper torso and leg alignment when shooting a basketball 50.

The alignment rod 20 is of a linearly elongated rod-like configuration fabricated of a semi-rigid plastic material. The alignment rod 20 is designed and configured so as to have a linear length which extends down a neck and spine, and concludes below the buttocks region of a user. The alignment rod 20 is adapted such that a lower end 21 thereof extends below the buttocks, thus engaging an extreme lower end of a spine of the user when properly worn.

An elastic forehead strap 30 is secured along a linearly elongated centerline thereof to an upper external circumferential sidewall of the alignment rod 20. The elastic forehead strap 30 is of a linearly elongated configuration fabricated of a resilient, elastic material, and has a first free end 32 opposite a second free end 33. The forehead strap 30 fits into an open channel 31 formed in the alignment rod 20 by means so as to be adjustable The forehead strap 30 is adapted so as to be wrapped around a forehead 23 of the user and overlap in front.

Figure 3:
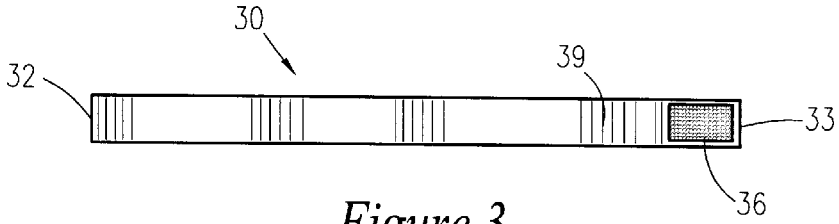
FIG. 3 is a top plan view of the forehead strap according to the preferred embodiment of the present invention.
Figure 4:
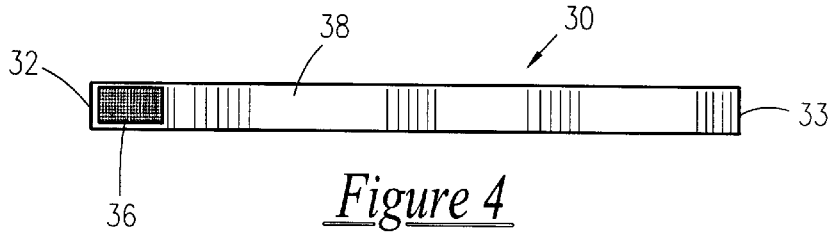
FIG. 4 is a bottom plan view thereof.

Referring now in greater detail to FIGS. 3 and 4, in order to be removably secured to the user's forehead 23, the forehead strap 30 has an elongated, rectangular layer of Velcro® material 36 sewn at the first free end 32 to a bottom side 38 thereof, and a corresponding elongated, rectangular layer of Velcro® material 36 sewn at the second free end 33 to a top side 39 thereof. With the alignment rod 20 extending parallel along a linear length of the spine of the user, the free ends 32, 33 of the forehead strap 30 are wrapped around one another in an overlapping manner such that the layers of Velcro® material 36 come into connective contact with one another, thereby removably securing the forehead strap 30 around the player's forehead 23. The linearly elongated design of the forehead strap 30 coupled with the elongated, rectangular layers of Velcro® material 36 sewn to ends 32, 33 thereof, provide a removably securable, adjustable device for accommodating all head sizes. Being fabricated of an elastic material, the forehead strap 30 is adapted so as to pliably conform around a user's head, thereby facilitating adherence therearound in a comfortable manner.

While securing the forehead strap 30 to the user's waist, a cushioned neck support 70 is brought into physical contact with user's rear neck area. The neck support 70 is of a hollow, rectangular configuration fabricated of a pliable, cushioned material and is suitably mounted by an external sidewall thereof to the circumferential sidewall of the alignment rod 20 in a perpendicular fashion below the forehead strap 30. The neck support 70 facilitates securement of the alignment rod 20 via the neck support 70 to the rear neck area of the user, and further serves to both immobilize and protect user's head and neck area.

A back pressure plate 90 having narrow, slightly bowed lateral fingers 92 protruding from opposite ends thereof is secured via a fastener such as a nut and bolt 93 within a linearly elongated plate adjustment channel 96 formed within the alignment rod 20 below the neck support 70. The back pressure plate 90 is of a rectangular configuration constructed of rigid rubber or plastic material. The fingers 92 of the back pressure plate 90 make physical contact with user's back area upon user over rotating his torso in a clockwise or counter-clockwise manner during an attempted basketball shot. The back pressure plate 90 thus serves to alert the user to adjust to the proper vertical alignment by shooting free of excessive torso rotation and to jump upward at an angle of 90° with respect to the floor.

Figure 10:
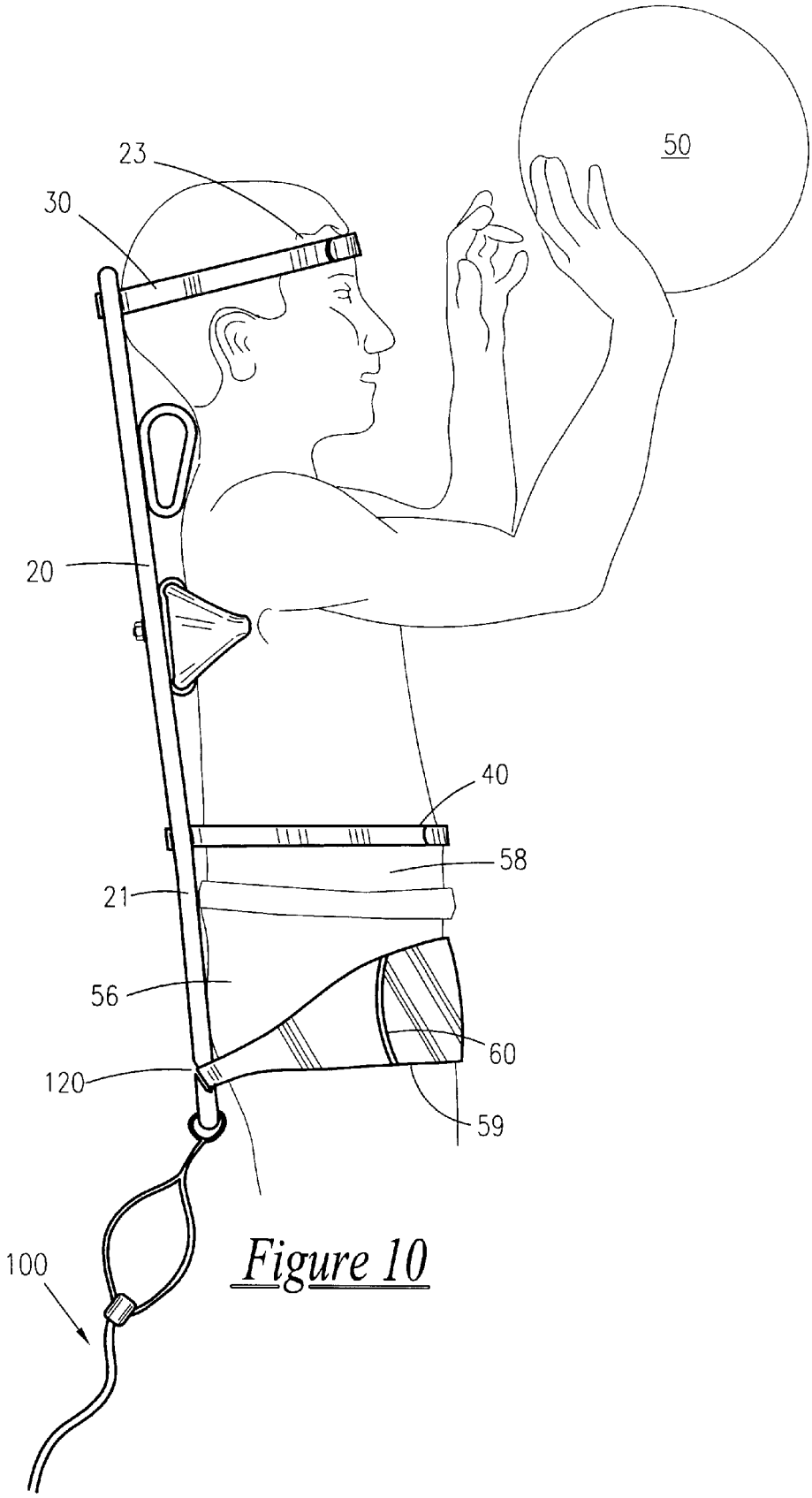
FIG. 10 is a perspective view of the present invention according to the preferred embodiment shown in-use.
Figure 11A:
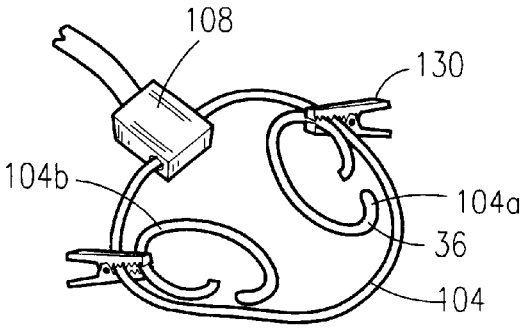
FIG. 11*a* is perspective view of the adjustable loop according to the preferred embodiment of the present invention.
Figure 11B:
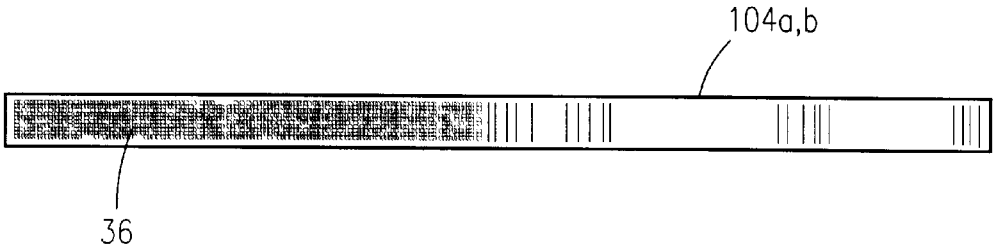
FIG. 11*b* is a top plan view of the ankle ring according to the preferred embodiment of the present invention.
Figure 11C:
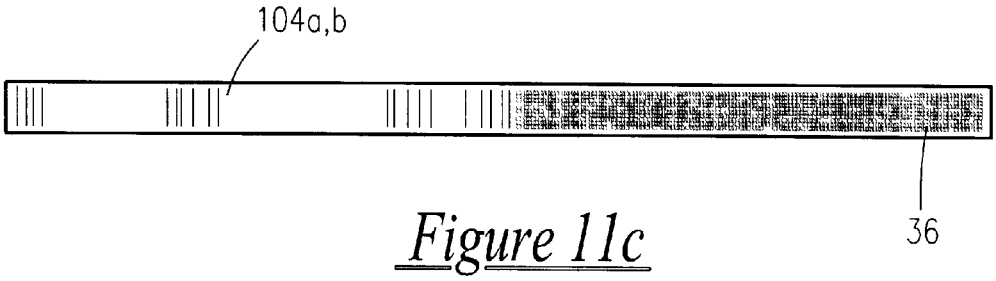
FIG. 11*c* is a bottom plan view of the ankle ring according to the preferred embodiment of the present invention.

During operation of the present invention, it is envisioned that the back pressure plate 90 should preferably come into physical contact with an area of the user's back as shown in FIG. 10. Thus, the elongated plate adjustment channel 96 allows the back pressure plate 90 to be vertically adjusted in a slidable manner so as to accommodate user's of various heights.

An elastic waist strap 40 is secured along a linearly elongated centerline thereof to a lower external circumferential sidewall of the alignment rod 20, in parallel alignment with the forehead strap 30. The waist strap 40 is of a linearly elongated configuration fabricated of a resilient, elastic material identical to the elastic material utilized for fabricating the forehead strap 30, and has a first free end 42 opposite a second free end 43. The waist strap 40 is adapted so as to be wrapped around a waist 58 of a user and overlap in front. The waist strap 40 fits into an open channel 41 in the alignment rod 20 so as to be adjustable.

Figure 5:
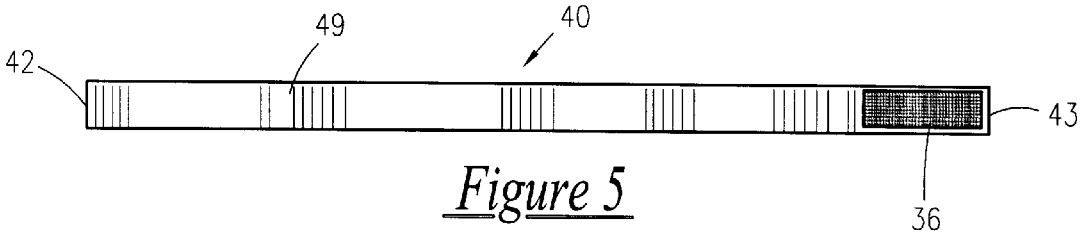
FIG. 5 is a top plan view of the waist strap according to the preferred embodiment of the present invention.
Figure 6:
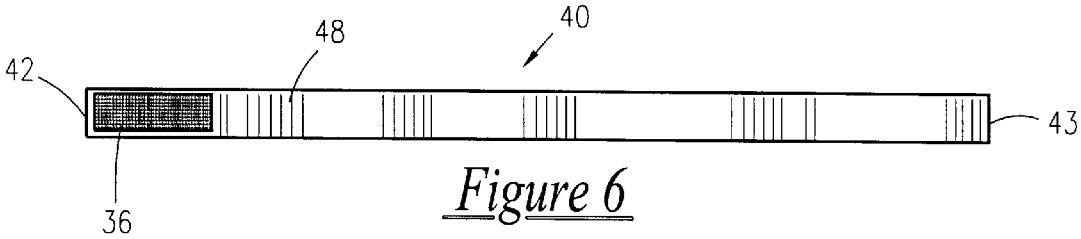
FIG. 6 is a bottom plan view thereof.

Referring now in greater detail to FIGS. 5 and 6, in order to be removably secured to a user's waist, the waist strap 40 has an elongated, rectangular layer of Velcro® material 36 sewn at the first free end 42 to a bottom side 48 thereof, and a corresponding elongated, rectangular layer of Velcro® material 36 sewn at the second free end 43 to a top side 49 thereof. With the alignment rod 20 extending parallel along a linear length of the spine of the user, the free ends 42, 43 of the waist strap 40 are wrapped around one another in an overlapping manner such that the layers of Velcro® material 36 come into connective contact with one another, thereby removably securing the waist strap 40 around the user's waist 58. The linearly elongated design of the waist strap 40 coupled with the elongated, rectangular layers of Velcro® material 36 sewn to free ends 42, 43 thereof, provide a removably securable, adjustable device for accommodating most waist 58 sizes. Being fabricated of an elastic material, the waist strap 40 is adapted so as to pliably conform around a user's waist, thereby facilitating adherence therearound in a comfortable manner.

Figures 2A, 2B:
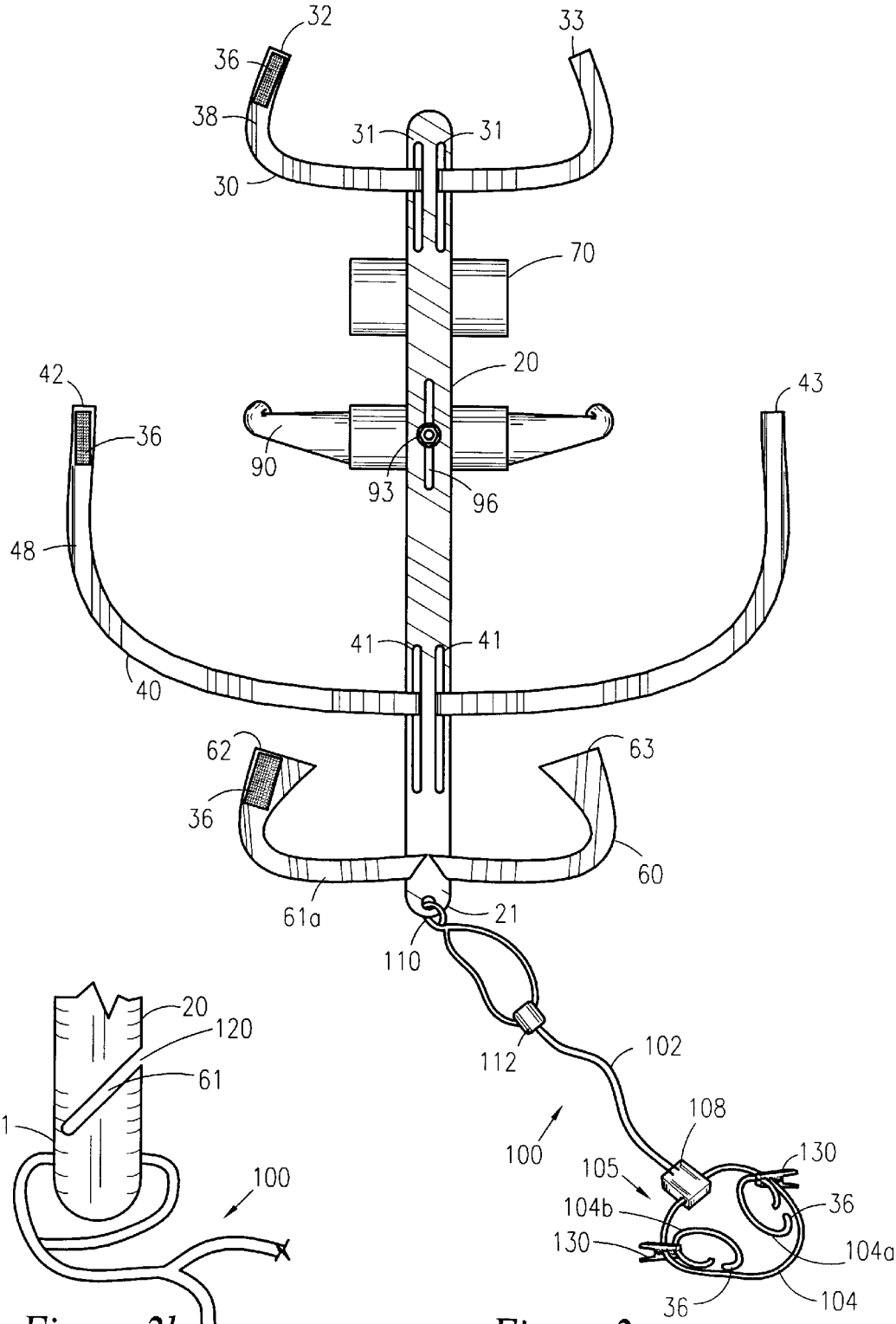
FIG. 2*a* is a rear side elevational view thereof.
FIG. 2*b* is a side elevational view of the support strap receiving channel of the alignment rod according to the preferred embodiment of the present invention.

Referring more specifically to FIGS. 2*a* and 2*b*, an elastic upper thigh support strap 60 is slidably received along a midportion 61*a* thereof within a support strap receiving channel 61 located below the elastic waist strap 40. A thigh strap detainment arm 120 is mounted parallel to an external circumferential sidewall of the alignment rod 20 just above the support strap receiving channel 61. The thigh strap detainment arm 120 extends downward just shy a linear length of an opening of the support strap receiving channel 61. The thigh strap detainment arm 120 serves to both allow insertion of the midportion 61*a* of the upper thigh support strap 60 within the support strap receiving channel 61, and to prevent accidental removal of the midportion 61*a* of the upper thigh support strap 60 therefrom during use. The upper thigh support strap 60 is of a linearly elongated configuration fabricated of the elastic material utilized for fabricating the forehead strap 30 and the elastic waist strap 40. The upper thigh support strap 60 is designed with wide opposing ends 62, 63 which taper in a direction to the midportion 61*a* of the upper thigh support strap 60. The opposing ends 62, 63 are adapted so as to be wrapped around an area between a user's waist 58 and an upper thigh region 59, and overlap in front.

The support strap receiving channel 61 is formed within the alignment rod 20 along a rear side thereof at a 45° angle. Such design serves to facilitate a comfortable yet strong pulling sensation around an upper thigh region 59 of the user upon user leaning forward to vertical alignment, which thus signals the user to adjust to a proper vertical alignment. For purposes of this disclosure, proper vertical alignment is defined as when the user attempts a set shot, or jumps upward when attempting a jump shot, while the feet are properly positioned and balanced, at an angle of 90° with respect to a floor.

Figure 7A:
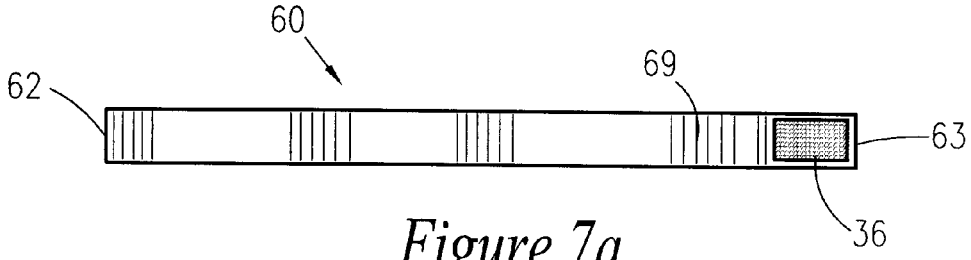
FIG. 7*a* is a top plan view of the lower waist support strap according to the preferred embodiment of the present invention.
Figure 7B:
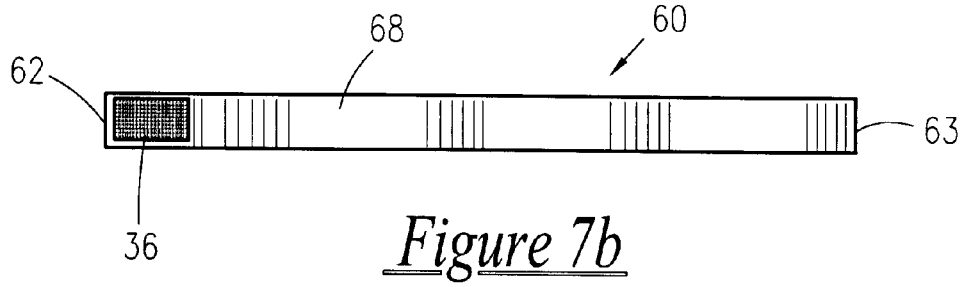
FIG. 7*b* is a bottom plan view thereof.
Figure 8:
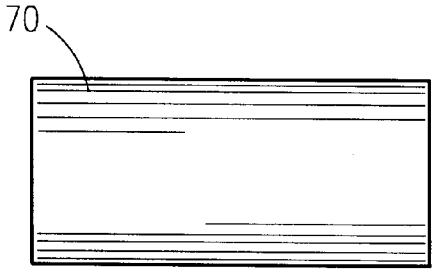
FIG. 8 is a perspective view of the cushioned neck support according to the preferred embodiment of the present invention.
Figure 9:
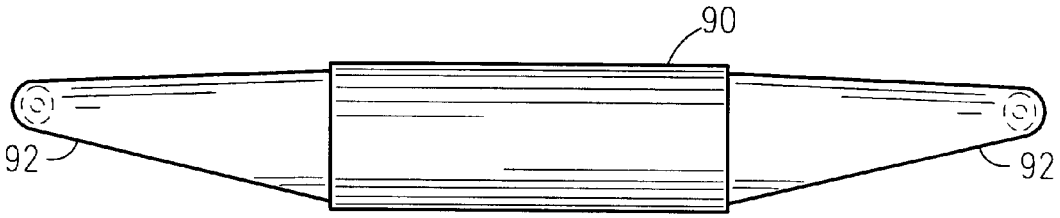
FIG. 9 is a perspective view of the back pressure plate according to the preferred embodiment of the present invention.

Referring now in greater detail to FIGS. 7*a* and 7*b*, in order to be removably secured to an area between the user's waist 58 and upper thigh region 59, the upper thigh support strap 60 has an elongated, generally rectangular layer of Velcro® material 36 sewn at end 62 to a bottom side 68 thereof, and a corresponding elongated, generally rectangular layer of Velcro® material 36 sewn at end 63 to a top side 69 thereof. With the alignment rod 20 extending parallel along a linear length of the spine of the user, the ends 62, 63 of the upper thigh support strap 60 are wrapped around one another in an overlapping manner such that the layers of Velcro® material 36 come into connective contact with one another, thereby removably securing the upper thigh support strap 60 around an area between the user's waist 58 and upper thigh region 59. The tapering design of the upper thigh support strap 60 serves to maintain secure and firm attachment of the alignment rod 20 to an extreme lower end of a spine of the user when properly worn.

It is envisioned that other suitable removably securable means may be substituted for the Velcro® material 36 illustrated herein for removably securing the free ends 32, 33 of the forehead strap 30, the free ends 42, 43 of the waist strap 40, and the opposing ends 62, 63 of the upper thigh support strap 60.

Referring more specifically to FIGS. 1, 2*a*, 2*b*, and 11*a*–11*c*, a feet immobilizing apparatus 100 comprised of a flexible, resilient, elastic belt 102, has an adjustable loop 104 formed at a first end 105 thereof opposite a second end which is attached to the external circumferential sidewall of the alignment rod 20 below the upper thigh support strap 60. The adjustable loop 104 is circumferentially adjusted and securely held to a desired circumferential measure via a belt adjustment and clamping device 108. The adjustable loop 104 is defined as having a pair of ankle rings 104*a*, 104*b*, wherein each of the pair of ankle rings 104*a*, 104*b* are removably attached thereto via a clamp means 130 along opposite circumferential sidewalls of the adjustable loop 104. The ankle rings 104*a*, 104*b* are designed and configured to be circumferentially adjusted around user's ankles and held to a desired position via Velcro® material 36. The feet immobilizing apparatus 100 serves to maintain the user's feet in proper position during consecutive basketball shots.

In order to accommodate users of various heights, an adjustment clasp 112 is provided for adjusting linearly a length of the feet immobilizing apparatus 100 and for securely maintaining a chosen length thereof.

Referring now to FIGS. 1–11*c*, after being properly secured to the user, the basketball shooting training device 10 is designed to maintain the user's back and head, from buttocks to a top of the head in vertical alignment, at an angle of approximately 90° with respect to a floor. In the event the user leans rearward to the vertical alignment, the lower end 21 of the alignment rod 20 firmly engages the extreme end of the user's spine, and in so doing, actuates a pulling force being exerted against the feet immobilizing apparatus 100, in turn creating a pulling force on user's ankles, whereby the user is alerted to adjust a sequential jump or set shot to a proper vertical alignment. In the event the user leans forward to the vertical alignment, the lower end 21 of the alignment rod 20 completely disengages the extreme end of the user's spine, thus actuating a pulling force being exerted against the feet immobilizing apparatus 100, and in turn creating a pulling force on user's ankles, whereby the user is alerted to adjust a sequential jump or set shot to a proper vertical alignment.

The use of the present invention serves to remind the user to habitually remain in the proper vertical alignment when shooting a basketball 50. The use of the present invention also maintains the user's feet position and balance for engaging the full leg strength when shooting the ball.

In addition, it is envisioned that the present invention can be utilized by a user to develop proper swing technique when playing other sports including but not limited to golf, tennis, baseball or hockey. For example, a number of mistakes are made by golfers during their golf swing which causes an inconsistent and ineffective swinging motion thereof resulting in improper club alignment at club impact with the golf ball. Such improper technique facilitates inaccurate ball flight, reduced power, and shorter distance. The use of the present invention facilitates even rotation of an upper torso around the spine by a golf player so as to aid in creating an effective golf swing which simultaneously yields maximum power, accurate flight, and longer distance.

2. Method for Applying the Present Invention

It is known in the art that maintaining a straight shooting forearm and maintaining elbows in close proximity to each other, as well as properly propelling the basketball 50 with revolution by the user's wrist are all important factors in developing a proper basketball shot so as to permit the acquisition of high shooting percentages. However, maintaining proper vertical alignment, proper feet position, and balance are all equally important factors which must be combined with the aforementioned factors for developing a proper basketball shot on a continual, habitual basis. The method for applying the basketball shooting training device 10 is disclosed henceforth.

After the basketball shooting device 10 is properly secured to a user, the user jumps vertically at angle of 90° with respect to a floor. At peak of jump, with elbows in close proximity in relation to one another, with a straight shooting forearm, and with a hand utilized as a basketball 50 trajectory guide, the user propels the basketball 50 by flipping a wrist with a proper trajectory toward a basket. In the event the user leans rearward to the vertical alignment, thus actuating the lower end 21 of the alignment rod 20 to firmly engage the extreme end of the user's spine, or leans forward, thus actuating the lower end 21 of the alignment rod 20 to completely disengage the extreme end of the user's spine, a pulling force is actuated and the pulling force is exerted against the feet immobilizing apparatus 100, in turn creating a pulling force on user's ankles, whereby the user is alerted to adjust a sequential jump to a proper vertical alignment. In the event the user over rotates his torso in a clockwise or counter-clockwise manner during an attempted basketball shot, the back pressure plate 90 alerts the user to adjust to the proper vertical alignment by shooting free of excessive torso rotation and to jump upward at an angle of 90° with respect to the floor. It should be noted that manipulative features stated heretofore are equally applicable and effective when shooting a set shot. For purposes of this disclosure, the term "set shot" means shooting a basketball 50 absent a vertical leap.

3. Operation of the Preferred Embodiment

To use the present invention, the user places the alignment rod 20 in a position such that it extends parallel along a linear length of his spine. Next, the user wraps the free ends 32, 33 of the forehead strap 30 around one another in an overlapping manner such that the layers of Velcro® material 36 come into connective contact with one another, thereby removably securing the forehead strap 30 around the user's forehead 23. The user then wraps the free ends 42, 43 of the waist strap 40 around one another in an overlapping manner such that the layers of Velcro® material 36 come into connective contact with one another, thereby removably securing the waist strap 40 around the user's waist 58. The user then slides the upper thigh support strap 60 through the support strap receiving channel 61 and the opposing ends 62, 63 of the upper thigh support strap 60 are wrapped around one another in an overlapping manner around an area between the user's waist 58 and upper thigh region 59. Next, the user removably secures each ankle ring 104*a*, 104*b* of the loop 104 of the feet immobilizing apparatus 100 around a respective ankle. The feet immobilizing apparatus 100 serves to maintain the user's feet in proper position during consecutive basketball shots. In the event the linear length of the feet immobilizing apparatus 100 requires adjustment so as to accommodate a user's particular height, the user simply adjusts the immobilizing apparatus 100 to a desired length and secures it in such position via the adjustment clasp 112.

Finally, after being properly secured to the user, the basketball shooting training device 10 is designed to maintain the user's back and head, from buttocks to a top of the head in vertical alignment, at an angle of approximately 90° with respect to a floor. In the event the user leans rearward to the vertical alignment, the lower end 21 of the alignment rod 20 firmly engages the extreme end of the user's spine, and in so doing, actuates a pulling force being exerted against the feet immobilizing apparatus 100, and in turn, creating a pulling force on user's ankles, whereby the user is alerted to adjust a sequential jump to the proper vertical alignment. In the event the user leans forward to the vertical alignment, the lower end 21 of the alignment rod 20 completely disengages the extreme end of the user's spine, and in so doing, actuates a pulling force being exerted against the feet immobilizing apparatus 100, and in turn, creating a pulling force on user's ankles, whereby the user is alerted to adjust a sequential jump to the proper vertical alignment. The user keeps both feet in proper parallel relationship with respect to each other which allows for the full motion and strength of the leg muscles to be used.

The use of the present invention serves to remind the user to habitually remain in proper vertical alignment, and to ensure correct feet position and balance when shooting a basketball 50.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A basketball shooting training device for training a user to employ the proper upper torso alignment when shooting a basketball comprising:

a linearly elongated alignment rod having a superior end opposite an inferior end;

an elastic forehead strap, affixed to said superior end;

an elastic waist strap affixed to said inferior end;

an elastic upper thigh support strap attaching said alignment rod to an area between a user's lower waist and an upper thigh region; and a feet immobilizing apparatus attaching said alignment rod to a user's ankles;

and wherein said device is designed to maintain the user's back and head, from buttocks to a top of the head in vertical alignment, at an angle of approximately 90° with respect to a floor and to further maintain user's feet in proper position during consecutive basketball shots.

2. The basketball shooting training device of claim 1, wherein said alignment rod is of a linearly elongated rod-like configuration fabricated of a semi-rigid plastic material.

3. The basketball shooting training device of claim 2, wherein said alignment rod is designed and configured so as to have a linear length which extends down a neck and spine, and concludes below the buttocks region of a user.

4. The basketball shooting training device of claim 3, wherein said alignment rod is adapted such that a lower end thereof extends below the buttocks and attaches to the waist via said elastic waist strap, and attaches to said upper thigh region via said elastic upper thigh support strap, thereby engaging an extreme lower end of a spine of the user when properly worn.

5. The basketball shooting training device of claim 4, wherein said elastic forehead strap is secured along a linearly elongated centerline thereof to an upper external circumferential sidewall of the alignment rod, said elastic forehead strap being of a linearly elongated configuration fabricated of a resilient, elastic material, and has a first free end opposite a second free end and fits into an open channel formed in said alignment rod so as to be horizontally and vertically adjustable.

6. The basketball shooting training device of claim 5, wherein in order to be removably secured to the user's forehead said forehead strap has an elongated, rectangular layer of hook and loop fastener material sewn at the first free end to a bottom side of the first free end, and a corresponding elongated, rectangular layer of hook and loop fastener material sewn at the second free end to a top side of the second free end, such that with said alignment rod extending parallel along a linear length of the spine of the user, the first free end and the second free end of said forehead strap are wrapped around one another in an overlapping manner such that the layers of hook and loop fastener material come into connective contact with one another, thereby removably securing said forehead strap around the user's forehead.

7. The basketball shooting training device of claim 6, wherein said elastic waist strap fits into an open channel in said alignment rod so as to be horizontally and vertically adjustable and in parallel alignment with said forehead strap.

8. The basketball shooting training device of claim 1, wherein said elastic waist strap is of a linearly elongated configuration fabricated of a resilient, elastic material, and has a first free end opposite a second free end.

9. The basketball shooting training device of claim 8, wherein in order to be removably secured to the user's waist said waist strap has an elongated, rectangular layer of hook and loop fastener material sewn at the first free end to a bottom side of the first free end, and a corresponding elongated, rectangular layer of hook and loop fastener material sewn at the second free end to a top side of the second free end, such that with said alignment rod extending parallel along a linear length of the spine of the user, the first free end and the second free end of said waist strap are wrapped around one another in an overlapping manner such that the layers of hook and loop fastener material come into connective contact with one another, thereby removably securing said elastic waist strap around the user's waist.

10. The basketball shooting training device of claim 1, wherein said elastic upper thigh support strap is of a linearly elongated configuration fabricated of a resilient, elastic material, and has wide opposing ends which taper in a direction to a midportion of said upper thigh support strap.

11. The basketball shooting training device of claim 10, wherein said elastic upper thigh support strap is slidably received along said midportion of said elastic upper thigh support strap within a support strap receiving channel located below said elastic waist strap and formed within said alignment rod along a rear side of said alignment rod at a 45° angle; and wherein said midportion is held within said support strap receiving channel during use by a thigh strap detainment arm mounted parallel to an external circumferential sidewall of said alignment rod just above said support strap receiving channel.

12. The basketball shooting training device of claim 11, wherein in order to be removably secured to the area between the user's lower waist and upper thigh region, said elastic upper thigh strap has an elongated, generally rectangular layer of hook and loop fastener material sewn at an end to a bottom side of the end, and a corresponding elongated, generally rectangular layer of hook and loop fastener material sewn at the opposing end to a top side of the opposing end, such that with said alignment rod extending parallel along a linear length of the spine of the user, the ends of said elastic upper thigh support strap are wrapped around one another in an overlapping manner such that the layers of hook and loop fastener material come into connective contact with one another, thereby removably securing said elastic upper thigh support strap around the area between the user's lower waist and upper thigh region.

13. The basketball shooting training device of claim 1, wherein said feet immobilizing apparatus is comprised of a flexible, resilient, elastic belt having an adjustable loop formed at a first end of said feet immobilizing apparatus opposite a second end, wherein said second end is attached to an external circumferential sidewall of said alignment rod below said upper thigh support strap.

14. The basketball shooting training device of claim 13, wherein said adjustable loop is defined as having a pair of ankle rings, wherein each of said pair of ankle rings are removably attached to said adjustable loop via a clamp means along opposite circumferential sidewalls of said adjustable loop, and said adjustable loop is circumferentially adjusted and securely held to a desired circumferential measure via a belt adjustment and clamping device.

15. The basketball shooting training device of claim 14, wherein said pair of ankle rings are designed and configured to be circumferentially adjusted around user's ankles and held to a desired position via hook and loop fastener material.

16. The basketball shooting training device of claim 13, wherein said feet immobilizing apparatus is further comprised of an adjustment clasp for adjusting a linear length of and for securely maintaining a chosen length of said feet immobilizing apparatus in order to accommodate users of various heights.

17. The basketball shooting training device of claim 1 further comprising:

a neck support, said neck support fabricated of a pliable, cushioned material suitably mounted by an external sidewall of said neck support to the circumferential sidewall of said alignment rod in a perpendicular fashion below said forehead strap so as to immobilize and protect user's head and neck area; and a back pressure plate, said back pressure plate having narrow, slightly bowed lateral fingers protruding from opposite ends of said back pressure plate, wherein said back pressure plate is secured via a fastener within a linearly elongated plate adjustment channel formed within said alignment rod below said neck support, and said back pressure plate is designed to make physical contact with user's back area upon user over rotating user's torso in a clockwise or counter-clockwise manner during an attempted basketball shot, thereby serving to alert the user to adjust to proper vertical alignment.

18. A method for applying the basketball shooting training device of claim 1, comprising the steps of:

(1) properly securing the basketball shooting device to user;

(2) jumping vertically at angle of 90° with respect to a floor;

(3) propelling basketball by flipping wrist with proper trajectory toward a basket at peak of jump with elbows in close proximity in relation to one another and with a straight shooting forearm; and (4) adjusting a sequential jump to proper vertical alignment in the event user either over rotates his torso in a clockwise or counter-clockwise manner during an attempted basketball shot, leans rearward to proper vertical alignment, leans forward to proper vertical alignment, or improperly positions feet.

* * * * *